United States Patent [19]

Peterson

[11] 4,075,929

[45] Feb. 28, 1978

[54] THREE STAGE THRUSTING DEVICE

[75] Inventor: Paul F. Peterson, Rancho Palos Verdes, Calif.

[73] Assignee: The United States of America as represented by the Secretary of the Air Force, Washington, D.C.

[21] Appl. No.: 653,055

[22] Filed: Jan. 28, 1976

[51] Int. Cl.[2] ..... F01B 15/00; F15B 11/18; F15B 15/22

[52] U.S. Cl. ..... 91/168; 91/209; 92/51; 92/108; 92/113

[58] Field of Search ..... 91/168, 286, 25, 26, 91/189 R, 209; 92/113, 108, 51

[56] References Cited

U.S. PATENT DOCUMENTS 3,557,550 1/1971 Legarra ..... 91/394

FOREIGN PATENT DOCUMENTS 248,259 1/1948 Switzerland ..... 91/168

*Primary Examiner*—Paul E. Maslousky

*Attorney, Agent, or Firm*—Joseph E. Rusz; Henry S. Miller

[57] ABSTRACT

A telescopic fluid ram or thruster utilizing pressurized gas and having an inner and outer piston that slides within a cylindrical bore including a central probe which is tapered and extends into the bore of the inner piston where it will cause the inner piston to move under high pressure while the gas escaping from around the tapered area produces a holding force to hold the outer piston in place until the inner piston is fully extended, at which time the outer piston will extend under a reduced pressure.

4 Claims, 3 Drawing Figures

THREE STAGE THRUSTING DEVICE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to thrusting devices and more particularly to simple, lightweight fluid operated thrusters.

Thrust devices that have been used in the past which are powered by either cold or hot gases generally are arranged that the thrust-time curve of the device follows the internal gas pressure of the device. This is especially true in the case of the basic cylinder and piston arrangement into which the gases are fed. The problem especially with hot gas devices, is that peak pressures are felt for only a very short period of time. Therefore, the devices being thrusted as well as the backup structure for the thruster must be of sufficient strength to accommodate a high load over a very short period of time. This in turn increases the weight of the parts which is highly undesirable in the case of aircraft, missile, or space structures.

Some thrusters are equipped with dual pistons of a telescopic nature wherein an inner piston rides in an outer piston which in turn rides a cylinder wall. With these types of thrusters, incoming gas at high pressure operates on the total areas of both pistons thereby pushing down both the outer and inner pistons simultaneously. Then, after the outer piston reaches bottom, the inner piston with the small area operating on low pressure gas continues on its stroke. It is highly desirable for the inner piston to complete its stroke first while pressures are high and are acting on the small piston area. Then, when the inner piston reaches bottom, the outer piston strokes using low pressure gas. To accomplish this, some thruster designs incorporate complex and heavy latching mechanism to keep the outer piston locked while the inner piston completes its stroke. In this fashion, a more even thrust versus time can be produced avoiding the high peak load and stretching out the maximum load over a longer period of time. This promotes efficiency in the thruster device creating high thrust over a long period of time with minimal peak forces.

SUMMARY OF THE INVENTION

The invention described herein is a three stage thrusting device embodying a probe, an inner piston, an outer piston, and a cylinder to contain these thruster parts. High pressure gas enters the gas inlet, passes through the probe and acts to force the inner piston outwardly to an extended position. This high pressure force acts only across the area of the probe. As the inner piston begins to stroke, undercut areas on the probe are exposed allowing small amounts of the high pressure gas to creep out into the area on top of the inner piston. This pressure begins to act on the collar of the outer piston causing it to remain in place. The probe arrangement has been proven as a very helpful concept in reducing peak loads and maintaining a very even thrust over a relatively long period of time.

As the inner piston continues to stroke, the high pressure gas eventually acts over all of the area of the inner piston. At this time, high pressure gas also applied a force against the collar attached to the outer piston. This gas pressure applies a load to the outer piston which will keep it in place against the cylinder. The inner piston continues its stroke until it reaches maximum extension at which point the piston ring snaps outward into its making groove in the inner wall of the outer piston. Now, the load holding the outer piston collar in place is completely cancelled and the outer piston is free to move. The outer piston starts down, pushing the inner piston down since they are now locked together by the piston snap ring. When the outer piston is in mid-stroke, gas pressures are relatively low. However, here all of the pistons now have a large area and thus the thrust loads during the entire stroke will be essentially quite level.

While these actions are taking place and gas is entering through the probe, some leakage may be experienced between the collar and the probe. This leakage could bleed to the top side of the outer piston, thus causing a displacement force and possible motion of the outer piston. To assure that this condition will not develop, small bypass grooves are cut into the top of the cylinder wall. These bypass grooves allow passage of small amounts of leakage gas to enter the outer chamber and exit through bleed holes in the end of the cylinder.

This device then embodies an automatic stroking sequence not encumbered by heavy latching devices that have been required in previous systems. It therefore will be a very lightweight device which will be capable of producing far greater areas under the load versus time curve than other devices where peak loads are very high for very short periods of time.

It is an object of the invention to provide a new and improved three stage thrusting device.

It is another object of the invention to provide a new and improved three stage thrusting device that is simple in design and low in cost.

It is a further object of the invention to provide a new and improved three stage thrusting device that is not encumbered by heaving latching systems that have been required in previous systems.

It is still another object of the invention to provide a new and improved three stage thrusting device that is light in weight.

It is still a further object of the invention to provide a new and improved three stage thrusting device that promotes efficiency by creating high thrust over a long period of time with minimal peak forces.

It is another object of the invention to provide a new and improved three stage thrusting device that is especially suited for use with high pressure hot gas or cartridge devices.

It is another object of the invention to provide a new and improved three stage thrusting device that is sufficient in speed and smoothness to allow it to be readily adaptable to a wide variety of uses.

These and other advantages, features and objects of the invention will become more apparent from the following description taken in connection with the illustrative embodiment in the accompanying drawings.

DESCRIPTION OF THE PREFERRED EMBODIMENT

Figure 1:
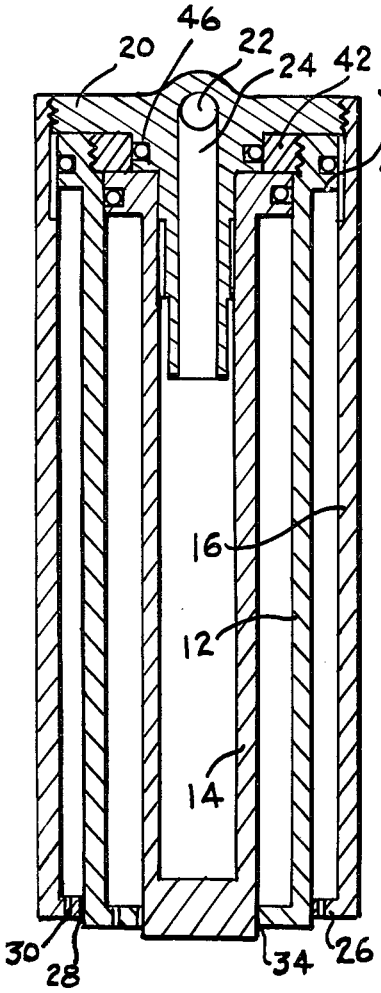
FIG. 1 is a crossectional view of the invention with all components retracted.

Referring now to FIG. 1, there is shown a telescopic thruster device comprising a cylinder shown generally at 10 and two concentric piston members 12 and 14 slidingly mounted within the cylinder.

The cylinder includes a polished wall structure 16 having a fluid bypass groove 18 at one end. Capping the cylinder is a threaded plug 20 containing a fluid entrance port 22 and tapered probe 24. The plug 20 engages the wall structure 16 and seals one end of the cylinder. The opposite end of the cylinder is capped at 26 with an opening sufficiently large to accept the piston 12 in a sliding relationship wherein the cap provides a bearing surface 28 for the piston member. Additionally, the cap is provided with at least one bleed hole 30 where gases or fluids may escape from the cylinder as the piston 12 moves from the retracted position.

Figure 2:
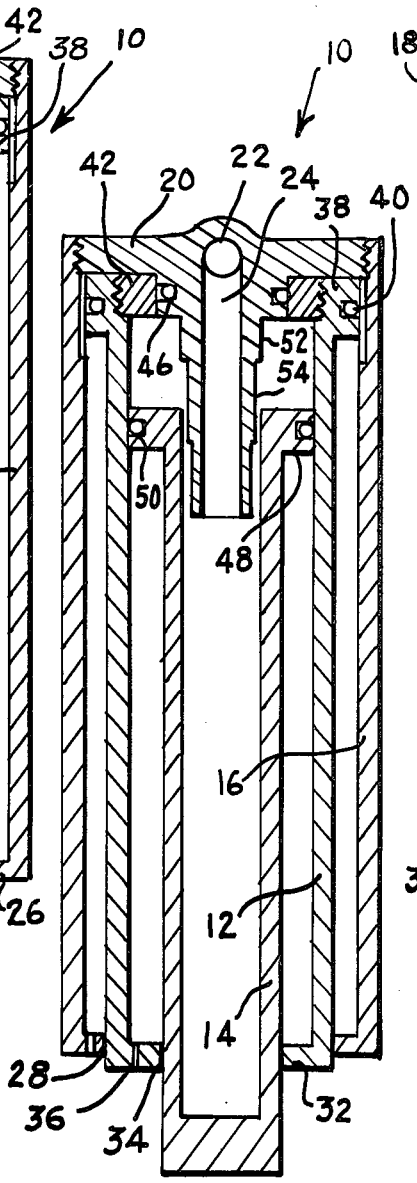
FIG. 2 is a crossectional view of the invention with the inner piston partially extended.
Figure 3:
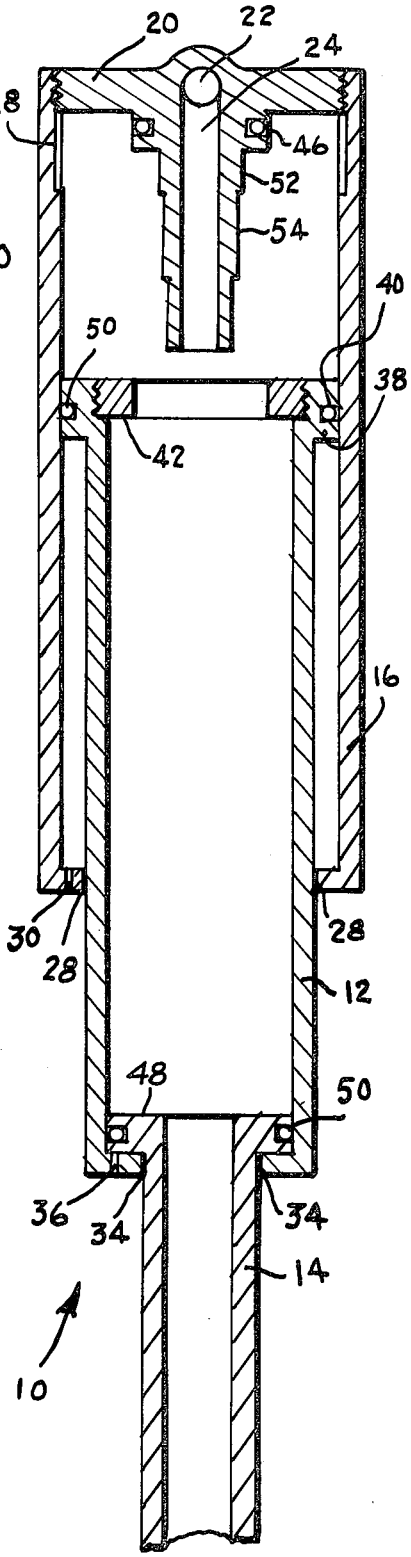
FIG. 3 is a crossectional view of the invention with the inner piston fully extended and the outer piston partly extended.

In FIG. 2, the inner piston 14 is partially extended through the end 32 of the outer piston 12. The end of piston 12 provides a sliding fit for the piston 14 and provides a bearing surface 34. Bleed holes 36 are provided to allow for the escape of fluids or gas as the piston extends. Piston 12 has an enlarged piston 38 adapted to engage the cylinder 16 and is fitted with a seal means 40 to prevent leakage of fluid past the piston when engaged with the cylinder wall. Inwardly of the enlarged portion, a collar 42 is mounted in threaded engagement with the piston 12. The collar abutts a projection 44 of the probe 24 and is sealed by the "O" ring or other suitable seal 46.

Inner piston 14 is formed with an enlarged section 48 at one end which is in sliding engagement with the polished inner wall of piston 12. A combination snap ring and seal 50 prevents gases or fluids from escaping past the enlarged section and is used to lock the two pistons together when the inner piston completes its stroke.

In operation, gas entering through port 22 travels through the probe 24 and into the interior of piston 14. The piston, having a snug fit with shoulder 52 of the probe immediately begins to extend as shown in the figure. High pressure gas begins to leak past the tapered section 54 of the probe 29, thereby exerting a force against the collar 42, holding piston 12 securely in place. Any gas leaking past the seal would flow through the bypass grooves and escape through the bleed holes 30.

When the inner piston reaches full extension, the force against collar 42 is overcome by the force applied to the piston 14, and the large piston 12 is moved from its retracted position breaking the seal 46 and causing seal 40 to engage the the wall of cylinder 16. The pressure within piston 12 is necessarily lower than the original pressure within piston 14. However, the area to which the force is applied is compensated for the change and both pistons move with equal force and speed.

The three stage thrusting device shown uses the described means for causing an even high velocity extension of the pistons without the pealing that is normally associated with devices of this type.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A three stage thrusting device comprising: a housing; first and second driving means telescopally mounted within the housing and adapted to extend from one end thereof, said first driving means positioned within said second driving means; means for sealing one end of the housing; probe means attached to the sealing means and extending into the first first driving means wherein said probe means is tapered and adapted to mate in a sealed relationship with a collar portion of said first driving means; port means in the end seal means and extending through the probe means for allowing fluid forces to act upon the said first and second means.

2. A three stage thrusting device according to claim 1 wherein: seal means are positioned between said housing and second driving means and between said second driving means and said first driving means to prevent fluid from escaping therebetween.

3. A three-stage thrusting device according to claim 2 wherein the second driving means is locked against motion only by system pressure, said locking being automatically relieved when the first driving means reaches the end of its stroke.

4. A three stage thrusting device according to claim 3 wherein said housing includes a bypass groove in the wall thereof to prevent the buildup of pressure by escaping fluid forces.

* * * * *